US011332276B2

(12) United States Patent
Liang

(10) Patent No.: US 11,332,276 B2
(45) Date of Patent: May 17, 2022

(54) PALLET AND PACKAGING STRUCTURE

(71) Applicants: Chongqing HKC Optoelectronics Technology Co., Ltd., Chongqing (CN); HKC Corporation Limited, Shenzhen (CN)

(72) Inventor: Shuozhen Liang, Chongqing (CN)

(73) Assignees: Chongqing HKC Optoelectronics Technology Co., Ltd, Chongqing (CN); HKC Corporation Limited, Shenzhen (CN)

( * ) Notice: Subject to any disclaimer, the term of this patent is extended or adjusted under 35 U.S.C. 154(b) by 0 days.

(21) Appl. No.: 17/043,578

(22) PCT Filed: Nov. 15, 2018

(86) PCT No.: PCT/CN2018/115525
§ 371 (c)(1),
(2) Date: Sep. 29, 2020

(87) PCT Pub. No.: WO2020/056896
PCT Pub. Date: Mar. 26, 2020

(65) Prior Publication Data

US 2021/0031974 A1 Feb. 4, 2021

(30) Foreign Application Priority Data

Sep. 20, 2018 (CN) ..... 201821530885.6
Sep. 20, 2018 (CN) ..... 201821546437.5

(51) Int. Cl.
*B65D 19/00* (2006.01)

(52) U.S. Cl.
CPC ..... *B65D 19/0073* (2013.01); *B65D 2519/00029* (2013.01); *B65D 2519/00064* (2013.01);
(Continued)

(58) Field of Classification Search
CPC .... B65D 19/38; B65D 19/20; B65D 19/0095; B65D 2519/00736; B65D 2519/00019;
(Continued)

(56) References Cited

U.S. PATENT DOCUMENTS 3,251,322 A 5/1966 Downs et al.
3,470,832 A * 10/1969 Heffernan ..... B65D 19/0028 108/53.3
(Continued)

FOREIGN PATENT DOCUMENTS

CN 2487661 Y 4/2002
CN 103359361 A 10/2013
(Continued)

OTHER PUBLICATIONS

International Search Report dated Jun. 27, 2019, issued in corresponding International Application No. PCT/CN2018/115525, filed Nov. 15, 2018, 2 pages.

*Primary Examiner* — Jose V Chen
(74) *Attorney, Agent, or Firm* — Christensen O'Connor Johnson Kindness PLLC

(57) ABSTRACT

Disclosed is a pallet, comprising first plywood, and foot piers fixedly arranged at a bottom side of the first plywood. The first plywood comprises a first batten layer and a second batten layer, wherein the first batten layer and the second batten layer are alternately arranged in a stacked manner, the first batten layer comprises several first battens arranged at intervals and along a first direction, and the second batten layer comprises several second battens arranged at intervals and along a second direction. The pallet not only has guaranteed strength but also has a relatively light weight.

19 Claims, 3 Drawing Sheets

(52) U.S. Cl.
CPC ..... *B65D 2519/00099* (2013.01); *B65D 2519/00273* (2013.01); *B65D 2519/00293* (2013.01); *B65D 2519/00323* (2013.01); *B65D 2519/00333* (2013.01); *B65D 2519/00562* (2013.01); *B65D 2519/00572* (2013.01)

(58) Field of Classification Search
CPC ..... B65D 2519/00054; B65D 2519/00089; B65D 2519/00124
USPC ..... 108/51.3, 57.25
See application file for complete search history.

(56) References Cited

U.S. PATENT DOCUMENTS 5,129,329 A * 7/1992 Clasen ..... B65D 19/0012 108/51.3
5,528,994 A * 6/1996 Iseli ..... B65D 19/0026 108/51.3
5,551,353 A * 9/1996 Fiedler ..... B29D 99/001 108/51.3
5,568,774 A * 10/1996 Hutchison ..... B65D 19/0012 108/51.3
5,601,035 A * 2/1997 Herring ..... B65D 19/0026 108/51.3
5,672,412 A * 9/1997 Phares ..... B32B 3/28 428/182
5,836,255 A * 11/1998 Uitz ..... B65D 19/0069 108/57.25
5,868,080 A * 2/1999 Wyler ..... B65D 19/0026 108/57.25
5,890,437 A * 4/1999 Hill ..... B65D 19/36 108/51.3
5,909,712 A * 6/1999 Tan ..... B65D 19/0075 108/51.3
5,996,509 A * 12/1999 Lai ..... B65D 19/0012 108/51.3
6,135,030 A * 10/2000 Besaw ..... B65D 19/0012 108/51.3
6,250,234 B1 * 6/2001 Apps ..... B29C 66/1142 108/57.25
6,283,044 B1 * 9/2001 Apps ..... B29C 65/2061 108/57.25
6,453,827 B1 * 9/2002 Perazzo ..... B65D 19/0012 108/51.3
6,705,237 B2 * 3/2004 Moore, Jr. ..... B65D 19/0012 108/57.25
6,807,910 B2 * 10/2004 Apps ..... B65D 19/0012 108/57.25
7,661,373 B2 * 2/2010 Apps ..... B65D 19/0012 108/56.3
RE44,178 E * 4/2013 Trickett ..... B65D 19/36 108/51.11
8,567,324 B1 * 10/2013 Paradis ..... B65D 19/0012 108/51.3
2002/0166481 A1 * 11/2002 Perazzo ..... B65D 19/0012 108/51.3
2002/0189507 A1 * 12/2002 Benner ..... B65D 19/0012 108/51.3
2003/0079657 A1 * 5/2003 Preisler ..... B65D 19/0018 108/51.3
2005/0229819 A1 * 10/2005 Hollander ..... B65D 19/0026 108/51.3
2006/0065168 A1 * 3/2006 Chen ..... B65D 19/0026 108/51.3
2006/0201399 A1 * 9/2006 Swistak ..... B65D 19/0059 108/57.25
2006/0207481 A1 * 9/2006 McCarthy ..... B65D 19/0026 108/51.3
2007/0107639 A1 * 5/2007 Dixon ..... B65D 19/0014 108/51.3
2007/0204768 A1 * 9/2007 Li ..... B65D 19/0016 108/57.25
2008/0196633 A1 * 8/2008 Ho ..... B65D 71/70 108/51.3
2008/0210140 A1 * 9/2008 Valentinsson ..... B65D 19/0014 108/57.25
2009/0188411 A1 * 7/2009 Gibson ..... B65D 19/0022 108/51.3
2010/0107933 A1 * 5/2010 Love ..... B65D 19/0069 108/51.3
2011/0120353 A1 * 5/2011 Jensen ..... B65D 19/0073 108/57.25
2012/0325125 A1 * 12/2012 Apps ..... B65D 19/0014 108/57.25

FOREIGN PATENT DOCUMENTS

CN 204223392 U 3/2015
CN 104670628 A 6/2015
GB 2127773 A * 4/1984 ..... B65D 19/0026
WO WO-9316927 A1 * 9/1993 ..... B65D 19/0026
WO WO-2020056896 A1 * 3/2020 ..... B65D 19/0073

* cited by examiner

PALLET AND PACKAGING STRUCTURE

CROSS REFERENCE TO RELATED APPLICATIONS

This application claims priority to the Chinese patent application No. 201821530885.6, entitled "PALLET AND PACKAGING STRUCTURE", and filed on Sep. 20, 2018, and the Chinese patent application No. 201821546437.5, entitled "Pallet and Packaging Structure", and filed on Sep. 20, 2018, the entire content of which is incorporated herein by reference.

TECHNICAL FIELD

The present application relates to the field of packaging, and in particular to a pallet and a packaging structure.

BACKGROUND

The statements herein merely provide background information related to the present application and do not necessarily constitute the prior art.

Liquid crystal glass is generally packaged by a pallet cooperated with a packaging box for transportation. The type of the pallet includes solid wood pallet and glued wood pallet. In general, when packaging and transporting the liquid crystal glass, the glued wood pallet is often used. Specifically, the glued wood pallet includes a glued wood board and a foot pier fixedly disposed on the bottom side of the glued wood board.

Generally, the glued wood board is formed by adhering a plurality of thin wood layers together as a whole piece of thick wood board through glue. However, such glued wood board is generally heavier, which in turn leads to a heavy pallet.

SUMMARY

In accordance with various embodiments of the present application, a light weight pallet and a package structure are provided.

According to an aspect of the present application, there is provided a pallet including a first glued wood board and a foot pier fixedly disposed on a bottom side of the first glued wood board, wherein the first glued wood board includes a plurality of first wood strip layers and a plurality of second wood strip layers, and the first wood strip layers and the second wood strip layers are alternately stacked, wherein the first wood strip layer includes a plurality of first wood strips arranged in a first direction and spaced apart from each other, and wherein the second wood strip layer includes a plurality of second wood strips arranged in a second direction and spaced apart from each other.

In the above pallet, the first wood strip layer includes a plurality of first wood strips arranged in the first direction and spaced apart from each other, and the second wood strip layer includes a plurality of second wood strips arranged in the second direction and spaced apart from each other. That is, the first wood strip layer and the second wood strip layer do not cover an entire plane of the first glued wood board, thereby reducing the weight of each first wood strip layer and each second wood strip layer. In this way, the weight of the first glued wood board is light, which in turn makes the pallet light.

In one embodiment, the first glued wood board further includes an upper surface, the first wood strip layer and the second wood strip layer are located on a side of the upper surface adjacent to the foot pier, and the upper surface covers an entire plane of the first glued wood board.

In one embodiment, the first glued wood board further includes a lower surface, the first wood strip layer and the second wood strip layer are located on a side of the lower surface away from the foot pier, and the lower surface covers an entire plane of the first glued wood board.

In one embodiment, the first direction is not parallel to the second direction.

In one embodiment, the first direction is perpendicular to the second direction.

In one embodiment, the first direction is parallel to one side edge of the first glued wood board.

In one embodiment, the plurality of the first wood strips have a same width.

In one embodiment, the plurality of the second wood strips have a same width.

In one embodiment, the first wood strip has the same width as the second wood strip.

In one embodiment, the first wood strips of two adjacent first wood strip layers are staggered in a stacking direction.

In one embodiment, the first wood strip of each of the first wood strip layers has a projection on an adjacent first wood strip layer with no overlap with the first wood strip of the adjacent first wood strip layer.

In one embodiment, a distance between adjacent first wood strips is equal to a width of the first wood strip in a same first wood strip layer.

In one embodiment, the second wood strips of two adjacent first wood strip layers are staggered in a stacking direction.

In one embodiment, the second wood strip of each of the second wood strip layers has a projection on an adjacent second wood strip layer with no overlap with the second wood strip of the adjacent second wood strip layer.

In one embodiment, a distance between adjacent second wood strips is equal to a width of the second wood strip in a same second wood strip layer.

In one embodiment, the first glued wood board further includes a plurality of third wood strip layers, the first wood strip layers, the second wood strip layers and the third wood strip layers are alternately stacked, and the third wood strip layer includes a plurality of third wood strips arranged in a third direction and spaced apart from each other.

In one embodiment, the first direction, the second direction, and the third direction are not parallel to each other.

In one embodiment, a second glued wood board located on a side of the foot pier away from the first glue wood board is further included, and fixedly connected to the foot pier.

In one embodiment, a bottom deck board located on a side of the foot pier away from the first glued wood board, and fixedly connected to the foot pier is further included.

According to another aspect of the present application, there is provided a package structure including a pallet including a first glued wood board and a foot pier fixedly disposed on a bottom side of the first glued wood board, wherein the first glued wood board includes a plurality of first wood strip layers and a plurality of second wood strip layers, and the first wood strip layers and the second wood strip layers are alternately stacked, wherein the first wood strip layer includes a plurality of first wood strips arranged in a first direction and spaced apart from each other, and wherein the second wood strip layer includes a plurality of second wood strips arranged in a second direction and spaced apart from each other.

Details of one or more embodiments of the present application are set forth in the accompanying drawings and description below. Other features, objects, and advantages of the disclosure will be apparent from the description and appended claims.

BRIEF DESCRIPTION OF THE DRAWINGS

To better describe and illustrate embodiments or examples of the disclosures disclosed herein, reference may be made to one or more drawings. The additional details or examples used to describe the figures are not to be construed as limiting the scope of any of the disclosed disclosure, the presently described embodiments or examples, and the best mode of the disclosures.

DETAILED DESCRIPTION OF THE EMBODIMENTS

In order to make the objects, technical solutions and advantages of the present application more clear, the present application will be further described in detail below with reference to the accompanying drawings and embodiments. It is understood that the specific embodiments described herein are merely illustrative of the application and are not intended to be limiting.

All technical and scientific terms used herein have the same meaning as commonly understood by a skilled person in the art to which this disclosure applies, unless otherwise defined. The terminology used herein is for the purpose of describing particular embodiments, and is not intended to be limiting. The technical features of the above embodiments may be arbitrarily combined. For the sake of brevity of description, all possible combinations of the technical features in the above embodiments are not described. However, as long as there is no contradiction in the combination of these technical features, it is considered to be the range described in this specification.

Figure 1:
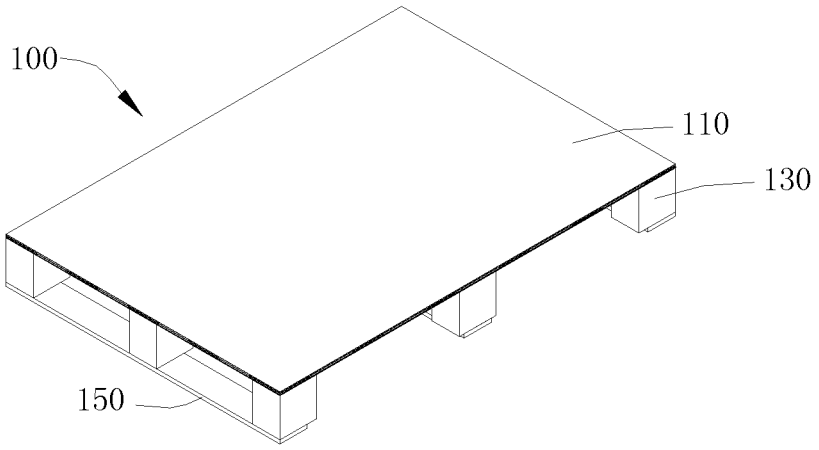
FIG. 1 is a schematic structural diagram illustrating a pallet according to an embodiment of the present application.
Figure 2:
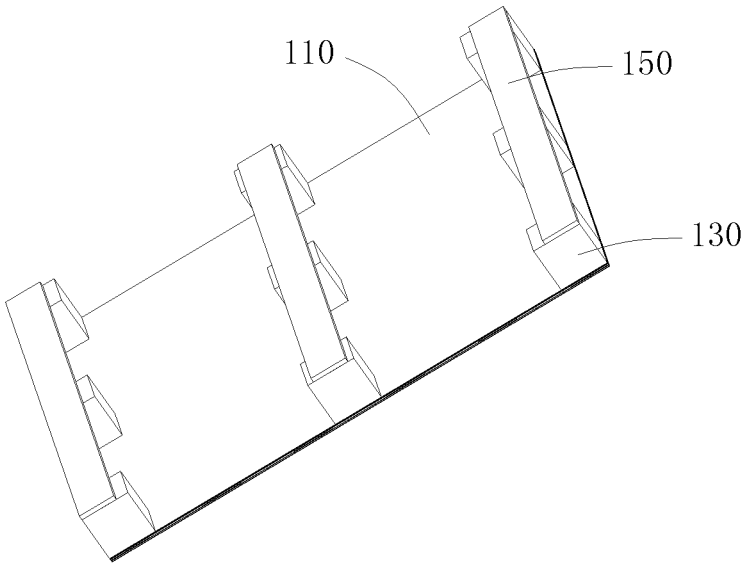
FIG. 2 is a schematic structural diagram illustrating the pallet shown in FIG. 1 in another direction.
Figure 3:
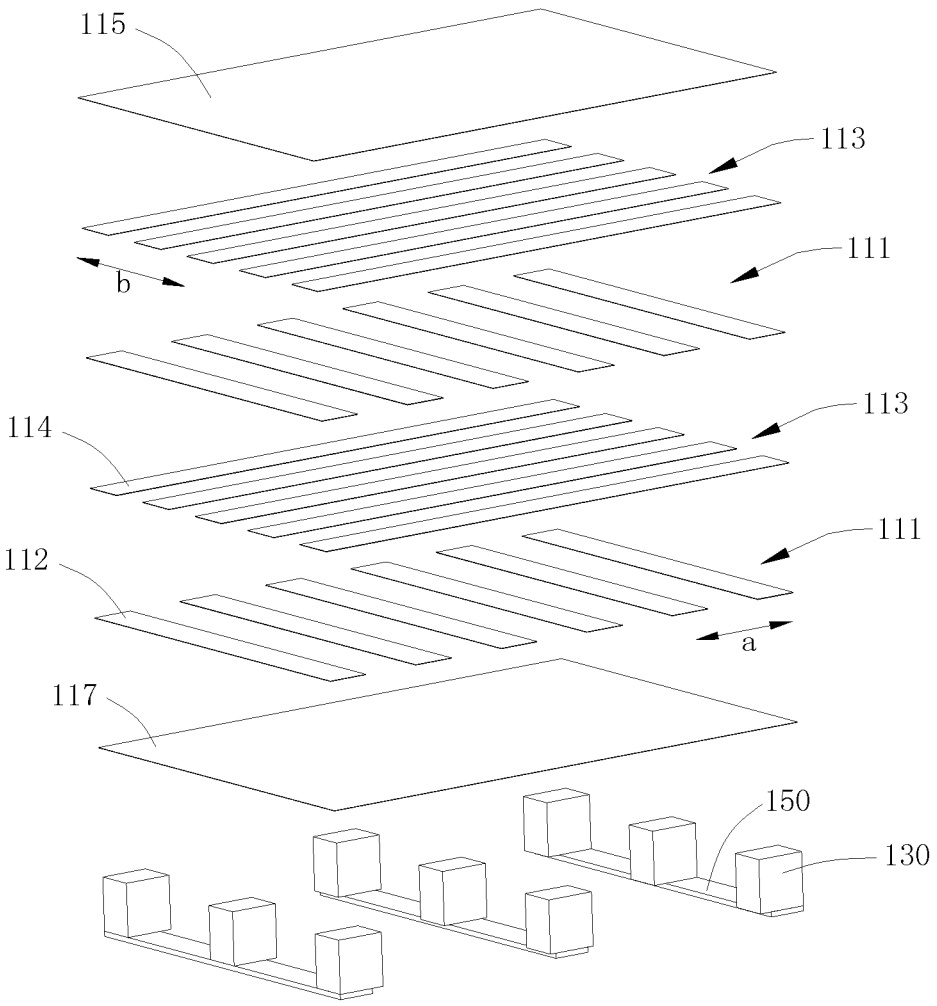
FIG. 3 is an exploded diagram illustrating the pallet shown in FIG. 1.

As shown in FIG. 1 to FIG. 3, a pallet 100 according to an embodiment of the present disclosure includes a first glued wood board 110 and a foot pier 130 fixedly disposed on a bottom side of the first glued wood board 110.

The first glued wood board 110 includes two first wood strip layers 111 and two second wood strip layers 113, and the first wood strip layers 111 and the second wood strip layers 113 are alternately stacked.

It can be understood that, in other embodiments, the number of the first wood strip layers 111 and the number of the second wood strip layers 113 are not limited to two, and may be one or more than two.

Specifically, the first wood strip layer 111 includes a plurality of first wood strips 112 arranged in a first direction A and spaced apart from each other. The second wood strip layer 113 includes a plurality of second wood strips 114 arranged in a second direction B and spaced apart from each other. It can be understood that the first direction A and the second direction B are both perpendicular to the thickness direction of the first glued wood board 110.

Referring to FIG. 3, the first wood strip layer 111 of the bottom layer is taken as an example, and it includes a plurality of first wood strips 112 arranged in the first direction A and spaced apart from each other. Similarly, the second wood strip layer 113 of the bottom layer is taken as an example, and it includes a plurality of second wood strips 114 arranged in the second direction B and spaced apart from each other. That is, the first wood strip layer 111 and the second wood strip layer 113 do not cover the entire plane of the first glued wood board, thereby reducing the weight of the first wood strip layer 111 and the second wood strip layer 113, so that the weight of the first glued wood board 110 is light, which in turn makes the pallet 100 light. At the same time, it consumes less raw materials and costs less. The first wood strips 112 of an upper first wood strip layer 111 are arranged in the same manner as the first wood strips 112 of a bottom first wood strip layer 111, and will not be described again. Similarly, the second wood strips 114 of the second wood strip layer 113 of an upper layer are arranged in the same manner as the second wood strips 114 of a bottom second wood strip layer 113.

The overlapping areas between the first wood strip layer 111 and the second wood strip layer 113 adjacent to the first wood strip layer 111 are laminated and adhered through glue.

In the embodiment, the first glued wood board 110 further includes an upper surface 115 and a lower surface 117. The first wood strip layer 111 and the second wood strip layer 113 are both located on the side of the upper surface 115 adjacent to the foot pier 130, and the first wood strip layer 111 and the second wood strip layer 113 are both located a side of the lower surface 117 away from the foot pier 130. In other words, the first wood strip layer 111, the second wood strip layer 113 and the foot pier 130 are located on the same side of the upper surface 115, while the first wood strip layer 111 and the foot pier 130 are located on opposite sides of the lower surface 117, and the second wood strips 113 and the foot pier 130 are located on opposite sides of the lower layer 117.

The upper surface 115 and the lower surface 117 cover the entire plane of the first glued wood board 110. That is, the upper surface 115 and the lower surface 117 have a complete plate-like structure with no gap therein. The upper surface of the first glued wood board 110 is flat to carry the liquid crystal glass better. The lower surface of the first glued wood board 110 is flat such that the surfaces of the plurality of foot piers 130 away from the side of the first glued wood board 110 are coplanar.

Of course, in other embodiments, the first glued wood board 110 may also include only the upper surface 115 or the lower surface 117.

In this embodiment, the first direction A is not parallel to the second direction B, so that in the same first wood strip layer 111, the spacing between two adjacent first wood strips 112 is relatively large, or in the same second wood strip layer 113, the spacing between two adjacent second wood strips 114 is relatively large, thereby further making the first glued wood board 110 light in weight.

Alternatively, the first direction A is perpendicular to the second direction B, on the one hand, it is relatively easy to implement in the process, and on the other hand, the first glued wood board 110 has a higher strength.

Of course, in other embodiments, the first direction A may be parallel to the second direction B. At this time, the first wood strip 112 and the second wood strip 114 are required to overlap each other such that the first glued wood board 110 is formed as a whole.

Alternatively, the first direction A is parallel to one side edge of the first glued wood board 110. It can be understood that the side edge of the first glued wood board 110 described herein refer to the side edges of the first glued wood board 110 that are perpendicular to the thickness direction thereof. Correspondingly, the first glued wood board 110 has a rectangular plate shape, so the second direction b is parallel to the other side of the first glued wood board.

As such, each first wood strip 112 of the first wood strip layer 111 has the same length, and each second wood strip 114 of the second wood strip layer 113 has the same length for ease of processing.

In this embodiment, the first wood strips 112 have a same width, and the second wood strips 114 have a same width, thereby facilitating processing.

Alternatively, the first wood strip 112 and the second wood strip 114 have the same width. On the one hand, it facilitates processing, and on the other hand, the strengths in the first direction A and the second direction B of the position at which the first wood strip 112 and the second wood strip 114 are attached are the same.

In the present embodiment, the pallet 100 further includes a bottom deck board 150 located on the side of the foot pier 130 away from the first glued wood board 110 and fixedly connected to the foot joint 130 to enhance the strength of the pallet 100. Specifically, the bottom deck board 150 may be in a shape of a Chinese character "川", a Chinese character "田", or a Chinese character "日".

Another embodiment of the present application further provides a pallet that, unlike the pallet 100, it further includes a second glued wood board located on the side of the footrest 130 that is away from the first glued wood board 110, but does not include the bottom deck board 150. The second glued wood board is fixedly connected to the foot pier 130. That is, the pallet is a double-sided pallet.

Alternatively, the second glued wood board has the same structure as the first glued wood board 110. Of course, in another embodiment, the structures of the second glued wood board and the first glued wood board 100 may also be different, for example, the number of the wood strip layers in the second glued wood board is different, the number of wood strips included in each wood strip layer is different or the width of the wood strips in the corresponding wood strip layers is different.

Specifically, in the embodiment, the foot pier 130 and the first glued wood board 110 are fixed by nails. Of course, in other embodiments, the foot pier 130 and the first glued wood board 110 can also be fixed by other means, such as bonding.

Figure 4:
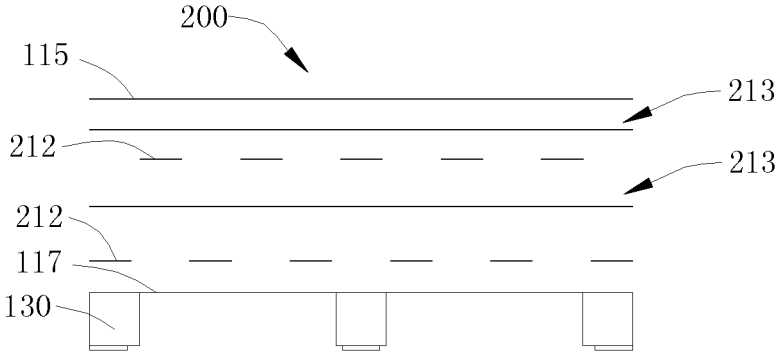
FIG. 4 is a front exploded diagram illustrating a pallet according to another embodiment of the present application.
Figure 5:
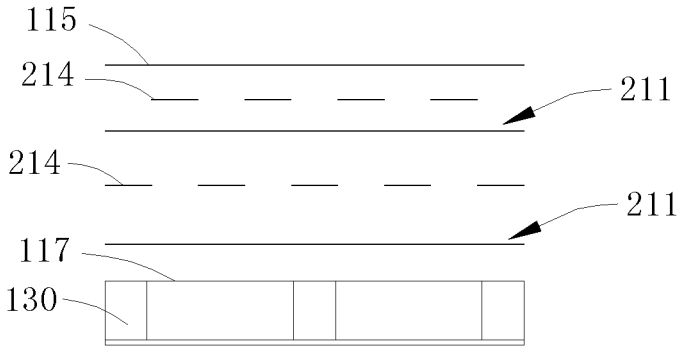
FIG. 5 is a side exploded diagram illustrating the pallet of FIG. 4.

As shown in FIG. 4 and FIG. 5, a pallet 200 according to another embodiment of the present application is different from the pallet 100 in that a first wood strip 212 of any first wood strip layer 211 and the first wood strip 212 of the adjacent first wood strip layer 211 are staggered in a stacking direction, that is, the first wood strips 212 of two adjacent first wood strip layers 211 do not completely overlap in the stacking direction. The second wood strip 214 of any second wood strip layer 213 and the second wood strip 214 of the adjacent second wood strip layer 213 are staggered in a stacking direction, that is, the second wood strips 214 of two adjacent second wood strip layers 213 do not completely overlap in the stacking direction.

It can be understood that the first wood strips 212 of the two adjacent first strip layers 211 are staggered in the stacking direction, that is, the first wood strip 212 of the first wood strip layer 211 and the first wood strips 212 of the adjacent first wood strip layer 211 are completely or partially staggered.

Similarly, the second wood strips 214 of the two adjacent second strip layers 213 are staggered in the stacking direction, that is, the second wood strip 214 of the second wood strip layer 213 and the second wood strip 214 of the adjacent second wood strip layer 213 are completely or partially staggered.

Similarly, in this embodiment, the position where the first wood strip 212 and the second wood strip 214 are adhered is attached by glue pressing. It can be understood that the region has a higher strength by means of glue press-fitting. That is, the position where the first wood strip 212 and the second wood strip 214 are attached has a high strength.

Alternatively, the first wood strip 212 of the first wood strip layer 211 and the first wood strip 212 of the adjacent first wood strip layer 211 are staggered in the stacking direction, and the second wood strip 214 of the second wood strip layer 213 and the second wood strip 214 of the adjacent second wood strip layer 213 are staggered in the stacking direction, that is, the distribution of pasting position of the first wood strip 212 and the second wood strip 214 is relatively dispersed, thereby avoiding the situation where the first glued wood board has a large difference in strength, that is, the strength of the first glued wood board is relatively balanced, so that the whole of the glued wood board has a high strength.

Of course, in another embodiment, only the first wood strips of the two adjacent first word strip layers may be staggered in the stacking direction, or only the second wood strips of the two adjacent second wood strip layers are staggered in the stacking direction.

In this embodiment, the projection of the first wood strip 212 of the first wood strip layer 211 on the adjacent first wood strip layer 211 completely avoids the first wood strip 212 of the layer, and the second wood strip 214 of the second wood strip layer 213 on the adjacent second wood strip layer 213 completely avoids the second wood strip 213 of the layer. Thereby, the bonding positions of the first wood strip layer 211 and the second wood strip layer 213 are more dispersed, further making the strength of the first glued wood board more uniform, thereby further improving the overall strength of the first glued wood board.

Of course, in another embodiment, only the projection of the first wood strip of the first wood strip layer in the adjacent first wood strip layer completely avoids the first wood strip of the layer, or the projection of the second wood strip of the second wood strip layer in the adjacent second wood strip layer completely avoids the second wood strip of the layer.

Alternatively, in this embodiment, in the same first wood strip layer 211, the distance between adjacent first wood strips 212 is equal to the width of the first wood strip 212. In the same second wood strip layer 213, the distance between the adjacent second wood strips 214 is equal to the width of the second wood strips 214. In this way, the areas where the first wood strips 112 and the second wood strips 114 fit together are evenly spread over the first glued wood board, thereby making the first glued board has a higher strength.

Of course, in another embodiment, only in the same first wood strip layer, the distance between adjacent first wood strips is equal to the width of the first wood strip; or in the same second wood strip layer, the distance between the adjacent second wood strips is equal to the width of the second wood strip.

In another embodiment of the present application, the first glued wood board further includes a plurality of layers of the third wood strip layer, and the first wood strip layer, the second wood strip layer and the third wood strip layer are alternately stacked. Wherein, the third wood strip layer includes a plurality of third wood strips spaced apart in the third direction.

Alternatively, the first direction, the second direction, and the third direction are not parallel.

Of course, it can be understood that the first glued wood board may also include more than three different layers of wood strips.

An embodiment of the present application provides a package structure including the pallet provided by the present application.

Generally, the packaging structure includes a packaging box. The application of the pallet in the packaging structure generally has three situations: the pallet directly serves as the bottom wall of the packaging box; the pallet is fixedly disposed on the bottom wall of the packaging box, and is located on the side of the bottom wall away from the inner cavity of the packaging box; and the pallet is placed on the bottom wall of the inner cavity of the package.

It can be understood that, in the present application, the manner in which the pallet is arranged in the packaging structure is applicable to the above three situations.

The package structure includes the pallet provided by the present application, the first wood strip layer includes a plurality of first wood strips arranged at intervals in the first direction, and the second wood strip layer includes a plurality of second wood strips arranged in the second direction. That is, the first wood strip layer and the second wood strip layer do not cover the entire plane of the first glued wood board, thereby reducing the weight of each layer of the thin wood board, so that the weight of the first glued wood board is light, thereby making the weight of the pallet board light.

In the above pallet, the first wood strip layer includes a plurality of first wood strips arranged in the first direction and spaced apart from each other, and the second wood strip layer includes a plurality of second wood strip layers arranged in the second direction and spaced apart from each other. That is, the first wood strip layer and the second wood strip layer do not cover the entire plane of the first glued wood board, thereby reducing the weight of each layer of the thin wood board, so that the weight of the first glued wood board is light, thereby making the weight of the pallet board light.

The technical features of the above-described embodiments may be combined in any combination. For the sake of brevity of description, all possible combinations of the technical features in the above embodiments are not described. However, as long as there is no contradiction between the combinations of these technical features, all should be considered as the scope of the specification.

The above-mentioned embodiments are merely illustrative of several embodiments of the present application, and the description thereof is more specific and detailed, but is not to be construed as limiting the scope of the disclosure. It should be noted that a number of variations and modifications may be made by those skilled in the art without departing from the spirit and scope of the present application. Therefore, the scope of protection of the application should be determined by the appended claims.

What is claimed is:

1. A pallet, comprising:

a first glued wood board; and a foot pier fixedly, disposed on a bottom side of the first glued wood board, wherein the first glued wood board comprises a plurality of first wood strip layers and a plurality of second wood strip layers, and the first wood strip layers and the second wood strip layers are alternately stacked, wherein the first wood strip layer comprises a plurality of first wood strips arranged in a first direction and spaced apart from each other;

wherein the second wood strip layer comprises a plurality of second wood strips arranged in a second direction and spaced apart from each other;

wherein the first glued wood board further comprises a lower surface;

wherein the first wood strip layer and the second wood strip layer are located on a side of the lower surface away from the foot pier; and wherein the lower surface covers an entire plane of the first glued wood board.

2. The pallet of claim 1, wherein the first glued wood board further comprises an upper surface, the first wood strip layer and the second wood strip layer are located on a side of the upper surface adjacent to the foot pier, and the upper surface covers an entire plane of the first glued wood board.

3. The pallet of claim 1, wherein the first direction is not parallel to the second direction.

4. The pallet of claim 3, wherein the first direction is perpendicular to the second direction.

5. The pallet of claim 4, wherein the first direction is parallel to one side edge of the first glued wood board.

6. The pallet of claim 1, wherein the plurality of the first wood strips have a same width.

7. The pallet of claim 1, wherein the plurality of the second wood strips have a same width.

8. The pallet of claim 1, wherein the first wood strip has the same width as the second wood strip.

9. The pallet of claim 1, wherein the first wood strips of two adjacent first wood strip layers are staggered in a stacking direction.

10. The pallet of claim 9, wherein the first wood strip of each of the first wood strip layers has a projection on an adjacent first wood strip layer with no overlap with the first wood strip of the adjacent first wood strip layer.

11. The pallet of claim 10, wherein a distance between adjacent first wood strips is equal to a width of the first wood strip in a same first wood strip layer.

12. The pallet of claim 1, wherein the second wood strips of two adjacent first wood strip layers are staggered in a stacking direction.

13. The pallet of claim 12, wherein the second wood strip of each of the second wood strip layers has a projection on an adjacent second wood strip layer with no overlap with the second wood strip of the adjacent second wood strip layer.

14. The pallet of claim 13, wherein a distance between adjacent second wood strips is equal to a width of the second wood strip in a same second wood strip layer.

15. The pallet of claim 1, wherein the first glued wood board further comprises a plurality of third wood strip layers, the first wood strip layers, the second wood strip layers and the third wood strip layers are alternately stacked, and the third wood strip layer includes a plurality of third wood strips arranged in a third direction and spaced apart from each other.

16. The pallet of claim 15, wherein the first direction, the second direction, and the third direction are not parallel to each other.

17. The pallet of claim 1, further comprising a second glued wood board located on a side of the foot pier away from the first glue wood board, and fixedly connected to the foot pier.

18. The pallet of claim 1, further comprising a bottom deck board located on a side of the foot pier away from the first glued wood board, and fixedly connected to the foot pier.

19. A packaging structure, comprising a pallet comprising a first glued wood board and a foot pier fixedly disposed on a bottom side of the first glued wood board, wherein the first glued wood board comprises a plurality of first wood strip layers and a plurality of second wood strip layers, and the first wood strip layers and the second wood strip layers are alternately stacked, wherein the first wood strip layer comprises a plurality of first wood strips arranged in a first direction and spaced apart from each other, wherein the second wood strip layer comprises a plurality of second wood strips arranged in a second direction and spaced apart from each other;

wherein the first glued wood board further comprises a lower surface;

wherein the first wood strip layer and the second wood strip layer are located on a side of the lower surface away from the foot pier; and wherein the lower surface covers an entire plane of the first glued wood board.

* * * * *